US008339022B2

(12) United States Patent
Wei et al.

(10) Patent No.: US 8,339,022 B2
(45) Date of Patent: Dec. 25, 2012

(54) FIELD EMISSION ELECTRON SOURCE HAVING CARBON NANOTUBES

(75) Inventors: Yang Wei, Beijing (CN); Zhuo Chen, Beijing (CN); Liang Liu, Beijing (CN); Shou-Shan Fan, Beijing (CN)

(73) Assignees: Tsinghua University, Beijing (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 12/954,859

(22) Filed: Nov. 27, 2010

(65) Prior Publication Data

US 2011/0101846 A1 May 5, 2011

Related U.S. Application Data

(60) Continuation of application No. 12/006,334, and a division of application No. 12/006,334, filed on Dec. 29, 2007, now Pat. No. 7,997,950.

(30) Foreign Application Priority Data

Nov. 2, 2007 (CN) ..... 2007 1 0124240

(51) Int. Cl.
*H01J 1/304* (2006.01)

(52) U.S. Cl. ..... 313/311; 313/336

(58) Field of Classification Search ..... 313/311, 313/310, 336, 495
See application file for complete search history.

(56) References Cited

U.S. PATENT DOCUMENTS

| | | | | |
|---|---|---|---|---|
| 6,504,292 | B1 * | 1/2003 | Choi et al. | 313/310 |
| 7,579,764 | B2 | 8/2009 | Wei et al. | |
| 2004/0095050 | A1 * | 5/2004 | Liu et al. | 313/309 |
| 2004/0169458 | A1 * | 9/2004 | Fran et al. | 313/495 |
| 2007/0084346 | A1 * | 4/2007 | Boyle et al. | 96/101 |
| 2008/0170982 | A1 | 7/2008 | Zhang et al. | |
| 2009/0117674 | A1 * | 5/2009 | Wei et al. | 438/20 |

FOREIGN PATENT DOCUMENTS

| | | |
|---|---|---|
| JP | 2003502798 | 1/2003 |
| JP | 2004303521 | 10/2004 |
| TW | I309428 | 5/2009 |
| WO | WO0077813 | 12/2000 |
| WO | WO2007015710 | 2/2007 |

* cited by examiner

*Primary Examiner* — Karabi Guharay
(74) *Attorney, Agent, or Firm* — Altis Law Group, Inc.

(57) ABSTRACT

A field emission electron source having carbon nanotubes includes a CNT string and a conductive base. The CNT string has an end portion and a broken end portion. The end portion is contacted with and electrically connected to the surface of the conductive base. The CNTs at the broken end portion form a tooth-shape structure, wherein some CNTs protrude and higher than the adjacent CNTs. Each protruded CNT functions as an electron emitter.

15 Claims, 8 Drawing Sheets

FIELD EMISSION ELECTRON SOURCE HAVING CARBON NANOTUBES

CROSS-REFERENCE TO RELATED APPLICATIONS

This application is a continuation application of patent application Ser. No. 12/006,334, filed on Dec. 29, 2007 now U.S. Pat. No. 7,997,950, from which it claims the benefit of priority under 35 U.S.C. 120. Both, this application and the patent application Ser. No. 12/006,334 claim the benefit of priority under 35 U.S.C. 119 from Chinese Patent Application No. 200710124240.2, filed on Nov. 2, 2007 in the China Intellectual Property Office. This application is related to commonly-assigned application, entitled "METHOD FOR MANUFACTURING FIELD EMISSION ELECTRON SOURCE HAVING CARBON NANOTUBES" with U.S. application Ser. No. 12/006,305, filed on Dec. 29, 2007 now U.S. Pat. No. 7,988,515 and "METHOD FOR MANUFACTURING FIELD EMISSION ELECTRON SOURCE HAVING CARBON NANOTUBES" with U.S. application Ser. No. 12/006,335, filed on Dec. 29, 2007 now U.S. Pat. No. 8,029,328. This application is a division of U.S. patent application Ser. No. 12/006,334, filed on Dec. 29, 2007, entitled, "FIELD EMISSION ELECTRON SOURCE HAVING CARBON NANOTUBES AND METHOD FOR MANUFACTURING THE SAME".

BACKGROUND

1. Technical Field

The disclosure relates to field emission electron sources and methods for manufacturing the same and, particularly, to a field emission electron source having carbon nanotubes and a method for manufacturing the same.

2. Discussion of Related Art

Carbon nanotubes (CNTs) produced by means of arc discharge between graphite rods were first discovered and reported in an article by Sumio Iijima, entitled "Helical Microtubules of Graphitic Carbon" (Nature, Vol. 354, Nov. 7, 1991, pp. 56-58). CNTs also feature extremely high electrical conductivity, very small diameters (much less than 100 nanometers), large aspect ratios (i.e. length/diameter ratios) (greater than 1000), and a tip-surface area near the theoretical limit (the smaller the tip-surface area, the more concentrated the electric field, and the greater the field enhancement factor). These features tend to make CNTs ideal candidates for field emission electron sources.

Generally, a field emission electron source having CNTs includes a conductive base and CNTs formed on the conductive base. The CNTs act as an emitter of the field emission electron source. The methods adopted for forming the CNTs on the conductive base mainly include mechanical methods and in-situ synthesis methods. The mechanical method is performed by respectively placing single CNT on a conductive base of an Atomic force microscope (AFM), then fixing the CNT on the conductive base with conductive pastes or adhesives. However, the controllability of the mechanical method is less than desired, because a single CNT is so tiny.

The in-situ synthesis method is performed by coating metal catalysts on a conductive base and synthesizing CNTs on the conductive base directly by means of chemical vapor deposition (CVD). However, the mechanical connection between the CNTs and the conductive base often is relatively weak and thus unreliable. In factual use, such CNTs are easy to be drawn away from the conductive base due to the electric field force, which would damage the field emission electron source and/or decrease its performance. Furthermore, the shield effect between the adjacent CNTs may reduce the field emission efficiency thereof.

What is needed, therefore, is a field emission source employing CNTs, which has a firm mechanical connection between CNTs and the conductive base, and has high field emission efficiency, and a controllable method for manufacturing the field emission source.

BRIEF DESCRIPTION OF THE DRAWINGS

Many aspects of the present disclosure can be better understood with reference to the following drawings. The components in the drawings are not necessarily to scale, the emphasis instead being placed upon clearly illustrating the principles of the present embodiments. Moreover, in the drawings, like reference numerals designate corresponding parts throughout the several views.

DETAILED DESCRIPTION

Reference will now be made to the drawings to describe the preferred embodiments of the present field emission electron source and the present method, in detail.

Figure 1:
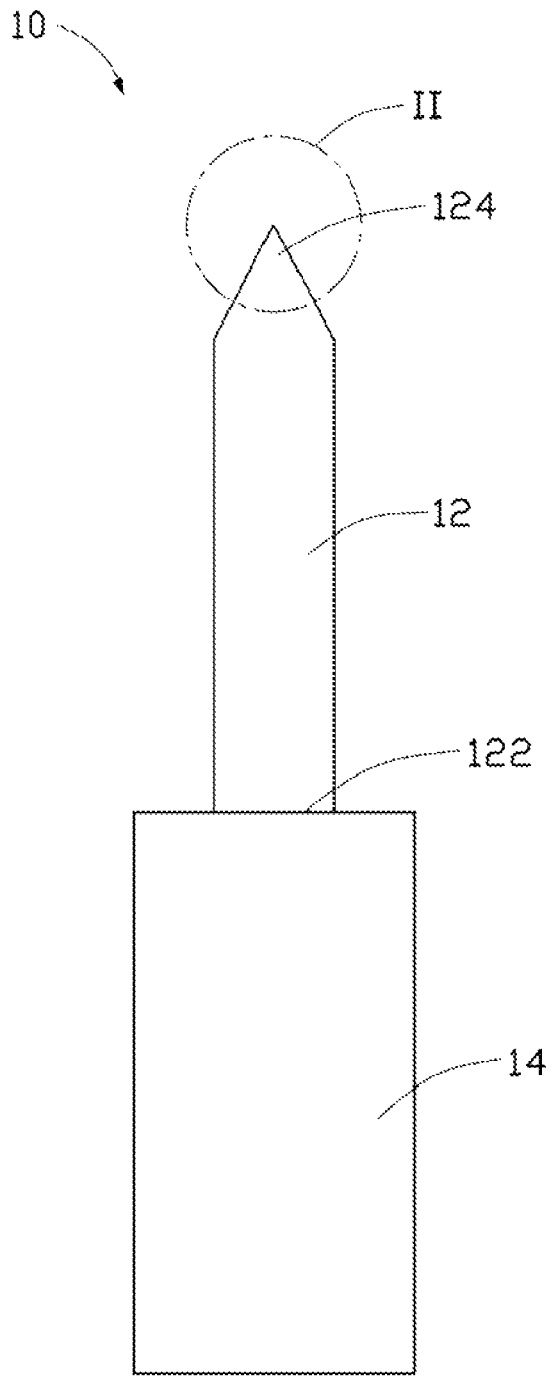
FIG. 1 is a schematic, cross-sectional view, showing the present field emission electron source.

Referring to FIG. 1, a field emission electron source 10 includes a CNT string 12 and a conductive base 14. The CNT string 12 includes an end portion 122 and a broken end portion 124. The CNT string 12 is attached to the conductive base 14 the end portion 122 is in contact with and electrically connected to the surface of the conductive base 14. The included angle between the longitudinal axis of the CNT string 12 with the surface of the conductive base 14 can be equal to or greater than 0 degrees and equal to or less than 90 degrees.

Figure 2:
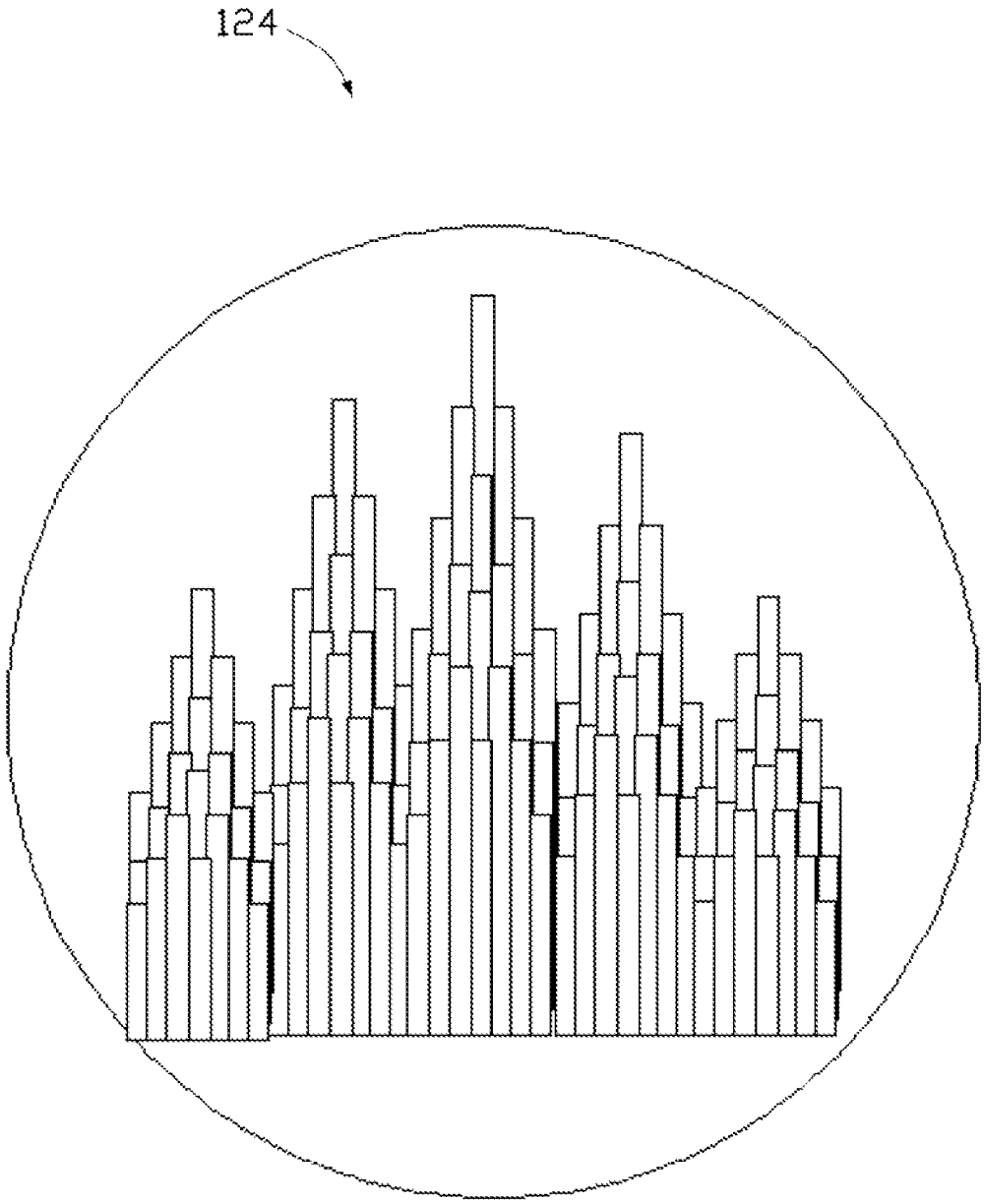
FIG. 2 is a schematic, amplificatory view of part II in FIG. 1.
Figure 3:
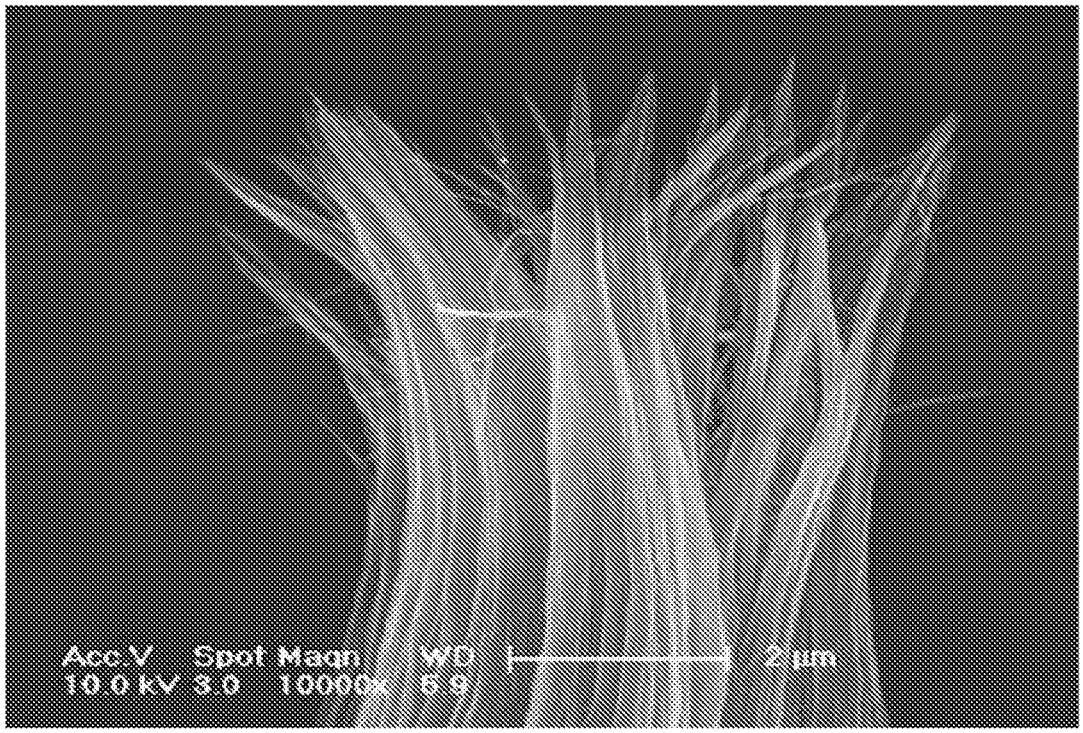
FIG. 3 is a Scanning Electron Microscope (SEM) photo, showing part II in FIG. 1.
Figure 4:
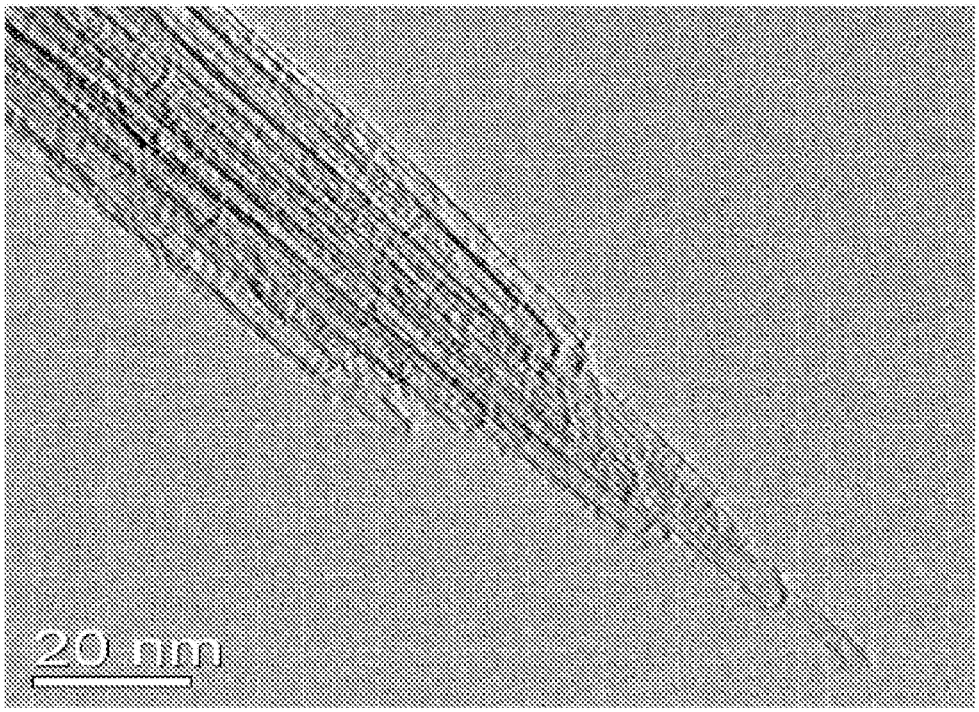
FIG. 4 is a Transmission Electron Microscope (TEM) photo, showing art II in FIG. 1.

The CNT string 12 is composed of a number of closely packed CNT bundles, and each of the CNT bundles includes a number of CNTs, which are substantially parallel to each other and are joined by van der Waals attractive force. A diameter of the CNT string 12 is in an approximate range from 1 to 100 microns (μm), and a length thereof is in an approximate range from about 0.1 to about 10 centimeters (cm). Referring to FIGS. 2, 3 and 4, the CNTs at the broken end portion 124 form a tooth-shaped structure, where some CNTs are protruding and are higher than the adjacent CNTs. The CNTs at the broken end portion 124 have a smaller diameter and a fewer number of graphite layers, typically, less than 5 nanometer (nm) in diameter and about 2-3 in wall. However, the CNTs in the CNT string 12 other than the broken end portion 124 are about 15 nm in diameter and more than 5 in wall. The conductive base 14 is made of an electrically conductive material, such as nickel, copper, tungsten, gold, molybdenum or platinum, or an insulated base with a conductive film formed thereon.

Figure 5:
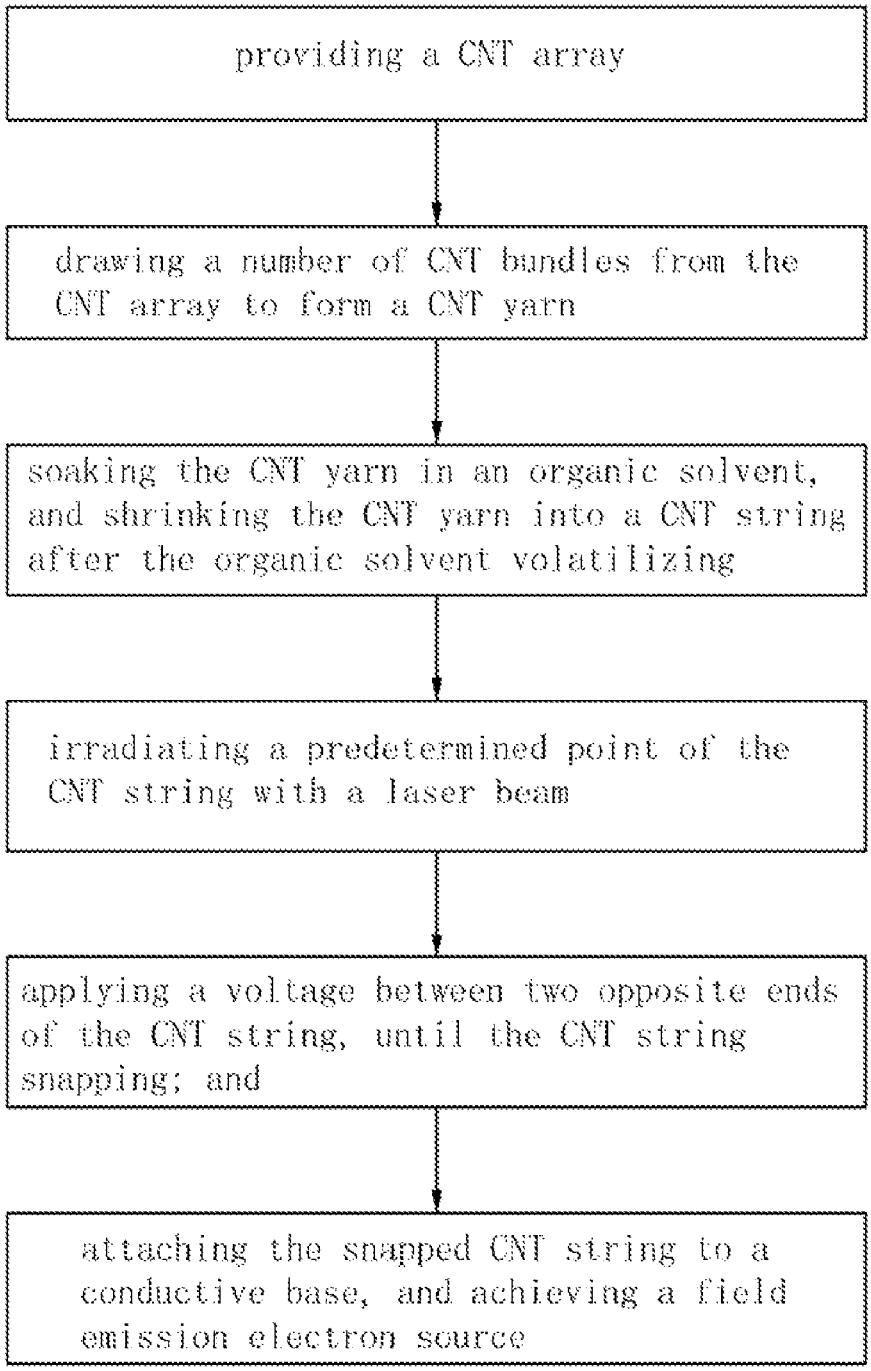
FIG. 5 is a process chart showing the steps of the method for manufacturing the present field emission electron source.

Referring to FIG. 5, a method for manufacturing the field emission electron source is illustrated as the following steps:

Step 1, providing a CNT array;

Step 2, drawing a number of CNT bundles from the CNT array to form a CNT yarn;

Step 3, soaking the CNT yarn in an organic solvent, and shrinking the CNT yarn into a CNT string after the organic solvent volatilizing;

Step 4, irradiating a predetermined point of the CNT string with a laser beam;

Step 5, applying a voltage between two opposite ends of the CNT string, until the CNT string snaps; and Step 6, attaching the snapped CNT string to a conductive base, and achieving a field emission electron source.

In step 1, the CNT array is a super-aligned CNT array, which is grown using a chemical vapor deposition method. The method is described in U.S. Pat. No. 7,045,108, which is incorporated herein by reference. First, a substrate is provided, the substrate is a p type silicon or n type silicon. Second, a catalyst layer is deposited on the substrate. The catalyst layer is made of a material selected from a group consisting of iron (Fe), cobalt (Co), nickel (Ni), and their alloys. Third, the substrate with the catalyst layer is annealed at a temperature in an approximate range from about 300 to about 400 degrees centigrade under a protecting gas for about 10 hours. Fourthly, the substrate with the catalyst layer is heated to approximately 500 to about 700 degrees centigrade and a mixed gas including a carbon containing gas and a protection gas is introduced for about 5 minutes to about 30 minutes to grow a super-aligned CNTs array. The carbon containing gas can be a hydrocarbon gas, such as acetylene or ethane. The protecting gas can be an inert gas. The grown CNTs are aligned parallel in columns and held together by van der Waals force interactions. The CNTs array has a high density and each one of the CNTs has an essentially uniform diameter.

In step 2, a CNT yarn may be obtained by drawing a number of the CNT bundles from the super-aligned CNTs array. Firstly, the CNT bundles including at least one CNT are selected. Secondly, the CNT bundles are drawn out using forceps or adhesive tape, to form a CNT yarn along the drawn direction. The CNT bundles are connected together by van der Waals force interactions to form a continuous CNT yarn. Further, the CNT yarn can be treated by a conventional spinning process, and a CNT yarn in a twist shape is achieved.

In step 3, the CNT yarn is soaked in an organic solvent. The step is described in U.S. Pat. Pub. No. 2007/0166223, which is incorporated herein by reference. Since the untreated CNT yarn is composed of a number of the CNTs, the untreated CNT yarn has a high surface area to volume ratio and thus may easily become stuck to other objects. During the surface treatment, the CNT yarn is shrunk into a CNT string 12 after the organic solvent volatilizing, due to factors such as surface tension. The surface area to volume ratio and diameter of the treated CNT string 12 is reduced. Accordingly, the stickiness of the CNT yarn is lowered or is eliminated, while strength and toughness of the CNT string 12 is improved. The organic solvent may be a volatilizable organic solvent, such as ethanol, methanol, acetone, dichloroethane, chloroform, and any combination thereof. A diameter of the CNT string 12 is in an approximate range from 1 to 100 microns (μm), and a length thereof is in an approximate range from 0.1-10 centimeters (cm).

Figure 6:
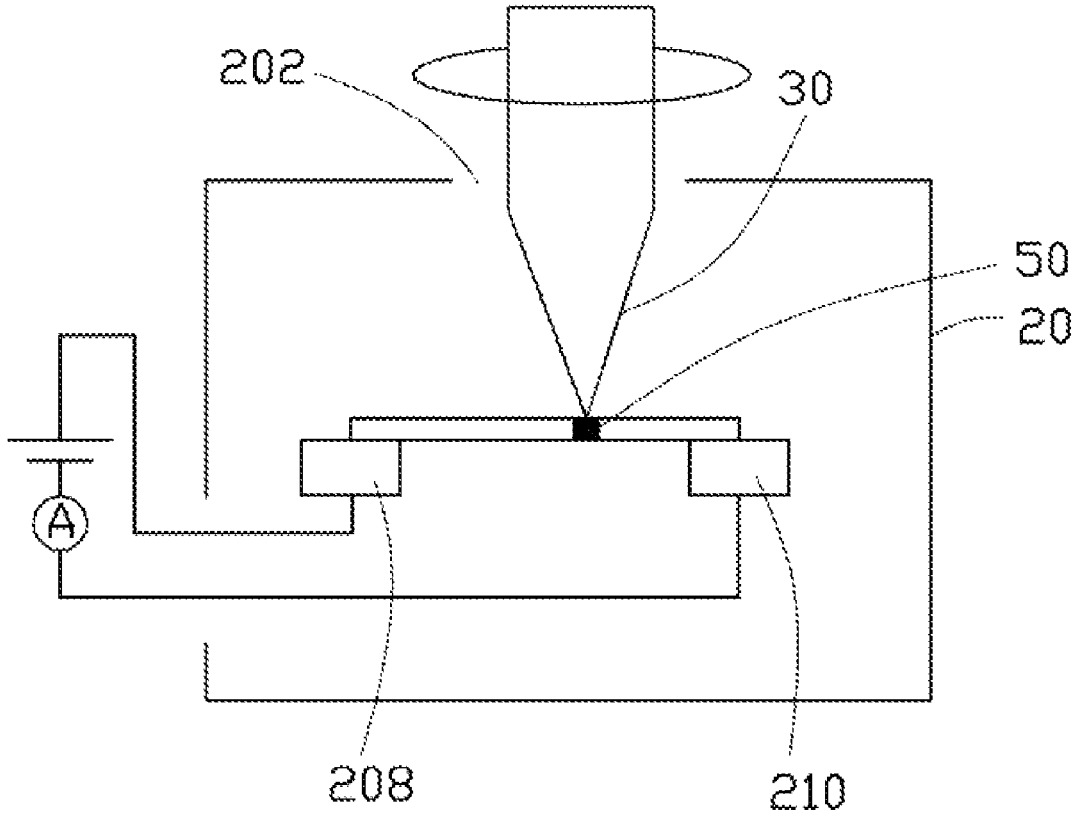
FIG. 6 is a schematic view, showing a laser beam irradiating a carbon nanotube string.

Referring to FIG. 6, the step 4 includes the following sub-steps:

In sub-step (1), the CNT string 12 is placed in a chamber 20. The chamber 20 includes a transparent window 202, an anode 208 and a cathode 210 therein. The anode 208 and the cathode 210 lead (i.e., run) from the inside to the outside of the chamber 20. Two opposite ends of CNT string 12 are attached to and electrically connected to the anode 208 and the cathode 210, respectively. In sub-step (2), a focused laser beam 30 radiates at a predetermined point 50 of the CNT string 12. The predetermined point 50 is located along a long-axial the CNT string 12. The laser beam 30 projects through the window 202 and scans perpendicular to the long-axial of the CNT string 12. In the present embodiment, a power of the laser beam is 12 watts (W), and a scanning velocity thereof is 100 mm/S.

In step 5, a voltage is applied between the anode 208 and the cathode 210 to apply a voltage on the CNT string 12. The voltage is determined according to a diameter and/or a length of the CNT string 12. In the present embodiment, the CNT yarn 12 is 2 cm in length and 25 μm in diameter, and then a 40 volts (V) DC dias is applied between the anode 208 and the cathode 210 to heat the CNT string 12 in air. After a while, the CNT string 12 is snapped at a predetermined point 50, and two snapped CNT strings 12 respectively having a broken end portion 124 are formed.

When the voltage is applied to the CNT string 12, a current flows through the CNT string 12. Consequently, the CNT string 12 is heated by Joule-heating, and a temperature of the CNT string 12 can reach an approximate range from 2000 to 2400 Kelvin (K). The resistance at the points distributing along the long axial of the CNT string 12 is different, and thus the temperature distributing along the long axial of the CNT string 12 is different. Due to the heat of the laser beam 30, the CNT string 12 is oxidized at the predetermined point 50, some defects are formed thereat, and thus the resistance at predetermined point 50 increases. The greater the resistance and higher the temperature, the easier it is for the CNT string to snap. In the present embodiment, after less than 1 hour (h), the CNT string 12 has snapped at the predetermined point 50.

Figure 7:
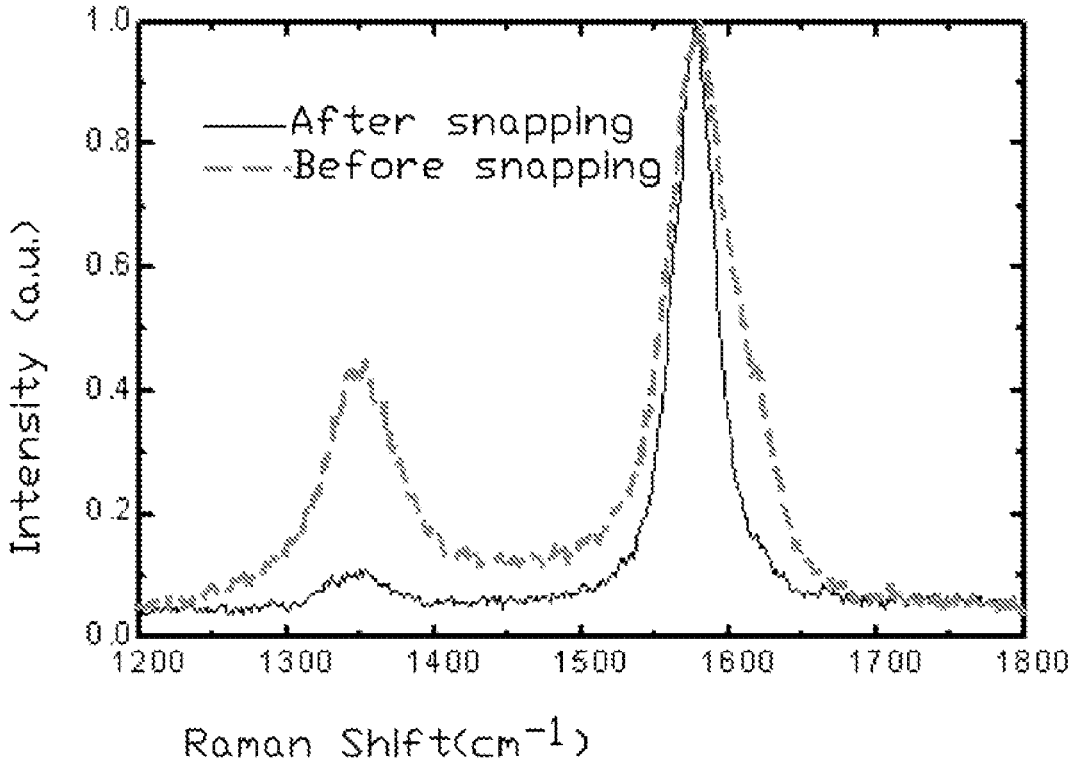
FIG. 7 is a Raman spectrum of the broken end portion of the present field emission electron source.

The CNTs at the broken end portion 124 have smaller diameter and a fewer number of graphite layers, typically, less than 5 nanometers (nm) in diameter and about 2-3 in wall. However, the CNTs in the CNT string 12 other than the broken end portion 124 are about 15 nm in diameter and more than 5 in wall. It can be concluded that the diameter and the number of the graphite layers of the CNTs decreases in a vacuum breakdown process. A wall by wall breakdown of CNTs is due to Joule-heating at a temperature higher than 2000K, with a current decrease process. The high-temperature process can efficiently remove the defects in CNTs, and consequently improve electric and thermal conductivity, and mechanical strength thereof. FIG. 7 shows a Raman spectrum of the broken end portion 124. After snapping, the intensity of D-band (defect mode) at 1350 $cm^{-1}$ is reduced, which indicates the structure effects at the broken end portion 124 are effectively removed, and thus the electric and thermal conductivity, and mechanical strength of the CNT string 12 are improved. Therefore, the field emission efficiency of the CNT string 12 is improved.

During snapping, some carbon atoms vaporize from the CNT string 12. After snapping, a micro-fissure (no labeled) is formed between two broken end portions 124, arc discharge may occur between the micro-fissure, and then the carbon atoms are transformed into the carbon ions due to ionization. These carbon ions bombard/etch the broken end portions 124, and then the broken end portion 124 form the tooth-shaped structure. Therefore, a shield effect caused by the adjacent CNTs can be reduced. The field emission efficiency of the CNT string 12 is further improved.

In step 6, the snapped CNT string 12 is attached to/electrically contacted with a conductive base 14. The end portion 122 of the CNT string 12 is attached to/electrically connected with a conductive base 14 by silver paste, the broken end portion 124 is a free end having the electron emitters, and then a field emission electron source 10 is formed.

Figure 8:
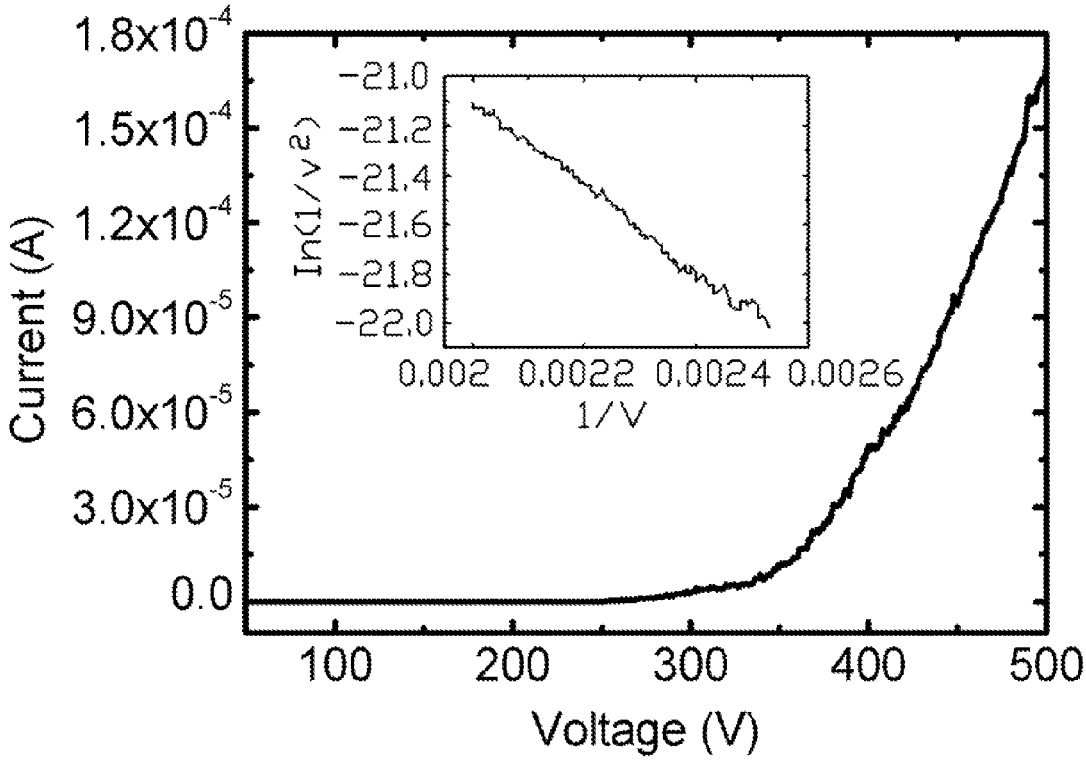
FIG. 8 is a current-voltage graph of the present field emission electron source.

FIG. 8 shows an I-V graph of the present field emission electron source. A threshold voltage thereof is about 250 V, an emission current thereof is over 150 μA. The diameter of the broken end portion is about 5 μm, and thus a current density can be calculated over 700 A/cm$^2$. The inset of FIG. 8 shows a Fowler-Nordheim (FN) plot, wherein the straight line (ln(I/V$^2$) by 1/V) indicates a typical field emission efficiency of the field emission electron source.

Finally, it is to be understood that the above-described embodiments are intended to illustrate rather than limit the invention. Variations may be made to the embodiments without departing from the spirit of the disclosure as claimed. The above-described embodiments illustrate the scope of the disclosure but do not restrict the scope of the invention.

What is claimed is:

1. A field emission electron source, comprising:

a carbon nanotube (CNT) string comprising a plurality of carbon nanotubes (CNTs) and a conductive base, wherein the CNT string comprises an end portion and a broken end portion, the end portion is in contact with and electrically connected to a surface of the conductive base, and the plurality of CNTs at the broken end portion form a tooth-shape structure, a diameter of a single CNT of the plurality of CNTs at the broken end portion is smaller than a diameter of the same single CNT at the end portion, the CNTs at the broken end portion comprise projecting CNTs taller than and projecting above the CNTs adjacent to the projecting CNTs, each of the projecting CNTs functions as an electron emitter.

2. The field emission electron source as claimed in claim 1, wherein the tooth-shape structure comprises a plurality of cone-shape structures, and each of the projecting CNTs is at a top center of each of the plurality of cone-shape structures.

3. The field emission electron source as claimed in claim 1, wherein a diameter of the CNT string is in a range from about 1 micron to about 100 microns.

4. The field emission electron source as claimed in claim 3, wherein each of the plurality of CNTs in the CNT string has a diameter of about 15 nanometers along a length of the CNT except at the broken end portion.

5. The field emission source as claimed in claim 4, wherein each of the plurality of CNTs at the broken end portion has a diameter of less than 5 nanometers.

6. The field emission electron source as claimed in claim 1, wherein the plurality of CNTs at the broken end portion comprises graphite layers, a number of the graphite layers is about 2 to 3.

7. The field emission electron source as claimed in claim 6, wherein the plurality of CNTs in the CNT string have the number of graphite layers more than 5 except at the broken end portion.

8. The field emission electron source as claimed in claim 1, wherein a length of the CNT string is in a range from about 0.1 centimeters to about 10 centimeters.

9. The field emission electron source as claimed in claim 1, wherein the CNT string is composed of a plurality of CNT numbers packed closely, each of the CNT bundles comprises the plurality of CNTs, and the plurality of CNTs are substantially parallel to each other and are joined by van der Waals attractive force.

10. The field emission electron source as claimed in claim 9, wherein the plurality of CNT bundles are connected together by van der Waals force interactions to form a carbon nanotube yarn; the CNT string comprises a shrunken structure formed by soaking the carbon nano tube yarn in an organic solvent and volatizing the organic solvent.

11. The field emission electron source as claimed in claim 9, wherein the plurality of CNT bundles are joined end-to-end with each other by van der Waals force.

12. The field emission electron source as claimed in claim 1, wherein the conductive base is an electrical conductive material comprising nickel, copper, tungsten, gold molybdenum, platinum, or any combination thereof.

13. The field emission electron source as claimed in claim 1, wherein the conductive base comprises an insulated base and a conductive film formed on a surface of the insulated base.

14. The field emission electron source as claimed in claim 1, wherein an angle between a longitudinal axis of the CNT string and the surface of the conductive base is greater than 0 degrees and equal to or less than 90 degrees.

15. The field emission electron source as claimed in claim 1, wherein the plurality of CNTs are composed of graphite layers, a number of graphite layers of the single CNT at the broken end portion is smaller than a member of graphite layers of the same single CNT at the end portion.

* * * * *